US012012968B2

(12) United States Patent
Lee et al.

(10) Patent No.: US 12,012,968 B2
(45) Date of Patent: Jun. 18, 2024

(54) WATER PUMP

(71) Applicant: COAVIS, Sejong-si (KR)

(72) Inventors: Hyuntae Lee, Sejong-si (KR); Hyungmin Kim, Cheongju-si (KR); Wookeun Lee, Sejong-si (KR); Dongheon Mo, Sejong-si (KR)

(73) Assignee: COAVIS, Sejong-si (KR)

( * ) Notice: Subject to any disclaimer, the term of this patent is extended or adjusted under 35 U.S.C. 154(b) by 0 days.

(21) Appl. No.: 18/366,313

(22) Filed: Aug. 7, 2023

(65) Prior Publication Data

US 2024/0052844 A1 Feb. 15, 2024

(30) Foreign Application Priority Data

Aug. 10, 2022 (KR) ..... 10-2022-0100188

(51) Int. Cl.

| | |
|---|---|
| ***F04D 29/046*** | (2006.01) |
| ***F04D 1/00*** | (2006.01) |
| ***F04D 29/22*** | (2006.01) |
| ***F04D 29/42*** | (2006.01) |

(52) U.S. Cl.

CPC ..... *F04D 29/046* (2013.01); *F04D 1/00* (2013.01); *F04D 29/22* (2013.01); *F04D 29/4293* (2013.01)

(58) Field of Classification Search

CPC ..... F04D 1/00; F04D 29/046; F04D 29/4293
See application file for complete search history.

(56) References Cited

U.S. PATENT DOCUMENTS

| | | | | |
|---|---|---|---|---|
| 10,781,828 | B2 * | 9/2020 | Graichen | F04D 29/0473 |
| 2018/0128279 | A1 * | 5/2018 | Ogawa | F04D 29/0467 |

FOREIGN PATENT DOCUMENTS

| | | | |
|---|---|---|---|
| JP | H06101686 | A | 4/1994 |
| JP | 2550398 | B2 | 11/1996 |
| JP | 2014173585 | A | 9/2014 |
| KR | 101457816 | B1 | 11/2014 |
| KR | 20180054954 | A | 5/2018 |
| KR | 102178862 | B1 | 11/2020 |
| KR | 20210034924 | A | 3/2021 |

OTHER PUBLICATIONS

Korean Intellectual Property Office, Office Action Issued in Application No. 10-2022-0100188, Mar. 22, 2024, 11 pages.

* cited by examiner

*Primary Examiner* — Courtney D Heinle
*Assistant Examiner* — John S Hunter, Jr.
(74) *Attorney, Agent, or Firm* — McCoy Russell LLP

(57) ABSTRACT

The present disclosure relates to a water pump in which a channel is formed so that a fluid introduced through an inlet side passes through a bearing part and a channel inside the rotor accommodation part and the rotor is formed so that the fluid may circulate, so a lubricating action of a bearing rotatably coupled to the rotor is smoothed and a pressure difference between upper and lower sides of an assembly of the rotor and an impeller assembly is reduced, thereby reducing abnormal noise and vibration in the bearing part.

9 Claims, 6 Drawing Sheets

WATER PUMP

CROSS-REFERENCE TO RELATED APPLICATION

This application claims priority under 35 U.S.C. § 119 to Korean Patent Application No. 10-2022-0100188, filed on Aug. 10, 2022, in the Korean Intellectual Property Office, the disclosure of which is incorporated herein by reference in its entirety.

TECHNICAL FIELD

The following disclosure relates to a water pump that pumps cooling water by rotating an impeller.

BACKGROUND

A water pump is a device for circulating a coolant to an engine or heater for cooling the engine or heating a room. The water pump is largely divided into a mechanical water pump and an electric water pump.

The mechanical water pump is a pump that is connected to a crankshaft of an engine and is driven according to the rotation of the crankshaft, and the electric water pump is a pump that is driven by a rotation of a motor controlled by a control device.

The electric water pump largely includes a housing, a stator, and a rotor constituting a motor unit, and an impeller and an impeller housing constituting a pump unit. In addition, the stator is provided inside the housing and fixed to the housing, the rotor is disposed to be spaced apart from the inside of the stator, the impeller is coupled to a rotary shaft of the rotor, and the impeller casing is coupled to the housing so as to cover the impeller.

FIG. 1 is a front cross-sectional view illustrating an example of the conventional electric water pump.

As illustrated, the conventional electric water pump is largely configured to include a motor housing 30, a stator 10, a lower casing 20, an upper casing 60, an impeller 50, and a rotor 40. The motor housing 30 is formed in a shape of a concave container with an upper side open, the stator 10 is inserted into the motor housing 30, and the lower casing 20 is coupled to the upper side of the motor housing 30, so a rotor accommodation part 21 of the lower casing 20 is inserted through a hollow inside of the stator 10. In addition, the rotor 40 is inserted into the rotor accommodation part 21, and the impeller 50 is disposed on an upper side of the rotor 40, and the rotor 40 and the impeller 50 are integrally coupled. In addition, the upper casing 60 is coupled to an upper side of the lower casing 20, and the impeller 50 is disposed in an impeller accommodation space, which is an internal space formed by the combination of the lower casing 20 and the upper casing 60. In addition, a lower bearing mounting part 22 is formed at a lower end of the rotor receiving portion 21 of the lower casing 20, and a lower bearing 42 composed of a bushing B and a support pin P is coupled to the lower bearing mounting part 22. In addition, in the upper casing 60, plate-like support parts 65 extend radially inward from an inner wall of an inflow channel, upper bearing mounting parts 64 are coupled to inner ends of the support parts 65, and an upper bearing 43 composed of the bushing B and the support pin P is coupled to the upper bearing mounting part 64. Thus, a lower end of a rotary shaft 41 of the rotor 40 is rotatably coupled to the lower bearing 42 and an upper end of the rotary shaft 41 is rotatably coupled to the upper bearing 43.

Here, in the conventional electric water pump, a fluid does not flow well toward the upper bearing 43 and the lower bearing 42, so the upper bearing 43 and the lower bearing 42 are not smoothly lubricated. In addition, when the impeller rotates and the fluid is pumped, abnormal noise and vibration occur in the upper bearing 43 and lower bearing 42 due to a fluid pressure difference between upper and lower sides of an assembly of the impeller 50 and rotor 40.

RELATED ART DOCUMENT

Patent Document

KR 10-2178862 B1 (Nov. 9, 2020) "Electric Water Pump"

SUMMARY

An embodiment of the present disclosure is directed to providing a water pump capable of smoothing a lubricating action of a bearing part to which a rotor is rotatably coupled and reducing a pressure difference between an upper side and a lower side of a rotor.

In one general aspect, a water pump includes: a lower casing in which a rotor accommodation part having a rotor accommodation space formed to be recessed from an upper surface to a lower side protrudes downward, a lower bearing mounting part is formed at an inner lower end of the rotor accommodation part, and a lower bearing is coupled to an inside of the lower bearing mounting part; an upper casing coupled to an upper side of the lower casing, having an impeller accommodation space therein by coupling with the lower casing, having an inlet part communicating with the impeller accommodation space to have a fluid be introduced thereinto and an outlet part through which the fluid is discharged, having an upper bearing mounting part extending from the inlet part, and having an upper bearing coupled to an inside of the upper bearing mounting part; an impeller provided to be rotatable in the impeller accommodation space; and a rotor provided in the rotor accommodation space of the lower casing, coupled to the impeller, and having both ends of a rotary shaft rotatably coupled to the lower bearing and the upper bearing, in which the upper bearing mounting part is provided with a cooling hole vertically penetrating through the inside and outside of the upper bearing mounting part.

The rotor may be provided with a communication channel penetrating up and down, and an inlet side of the impeller coupled to an upper end of the rotor and a lower end side of the rotor may communicate with each other by the communication channel.

The rotor accommodation part of the lower casing may be provided with a communication groove formed to be recessed on an inner circumferential surface along a vertical direction.

The rotor accommodation part may be provided with a lower cooling channel communicating with the inside of the lower bearing mounting part at an outer lower end of the lower bearing mounting part.

The upper casing may further include a plurality of supporting stands having an upper end connected to a lower inner wall of the inlet part and a lower end connected to the upper bearing mounting part, and the upper bearing mounting part may extend from a lower end of the inlet part toward the impeller accommodation space.

A portion or all of the upper bearing mounting part may be disposed inside the inlet side of the impeller.

The lower end of the inlet side of the impeller and the upper end of the rotor may be provided with an insertion groove formed to be recessed downward, and the upper bearing mounting part may be inserted into the insertion groove and spaced apart therefrom.

The rotor may be provided with a communication channel connecting the lower end side of the rotor and the insertion groove through the top and bottom thereof.

The water pump may further include: a motor housing formed in a shape of a concave container with an upper side open; and a stator provided inside the motor housing.

A protruding rib may be formed on the outer circumferential surface of the rotor accommodation part of the lower casing along the vertical direction, and the protruding rib may be inserted between adjacent teeth of the stator, and a communication groove may be formed to be recessed on an inner circumferential surface along a vertical direction at a position corresponding to the protruding rib.

| [Detailed Description of Main Elements] | |
|---|---|
| 100: Stator | |
| 110: Core | 120: Teeth |
| 130: Insulator | 140: Coil |
| 200: Lower casing | |
| 211: Lower seating groove | |
| 212: Lower channel groove | |
| 220: Rotor accommodation part | |
| 221: Rotor accommodation space | |
| 222: Lower bearing mounting part | |
| 223: Lower cooling channel | |
| 230: Protruding rib | |
| 240: Communication groove | |
| 300: Motor housing | |
| 400: Rotor | 410: Rotary shaft |
| 411: Lower bearing | 412: Upper bearing |
| 420: Insertion groove | |
| 430: Communication channel | |
| B: Bushing | P: Support pin |
| S: Ball | |
| 500: Impeller | |
| 510: Upper plate | 520: Lower plate |
| 530: Blade | |
| 600: Upper casing | |
| 601: Impeller accommodation space | |
| 602: Upper bearing mounting part | |
| 602a: Cooling hole | |
| 603: Inclined surface | |
| 610: Inlet part | 611: Inlet channel |
| 612: Supporting stand | |
| 620: Outlet part | 621: Outlet channel |
| 630: Upper seating groove | |
| 632: Upper channel groove | |

DETAILED DESCRIPTION OF EMBODIMENTS

Hereinafter, a water pump of the present disclosure will be described in detail with reference to the accompanying drawings.

Figure 1:
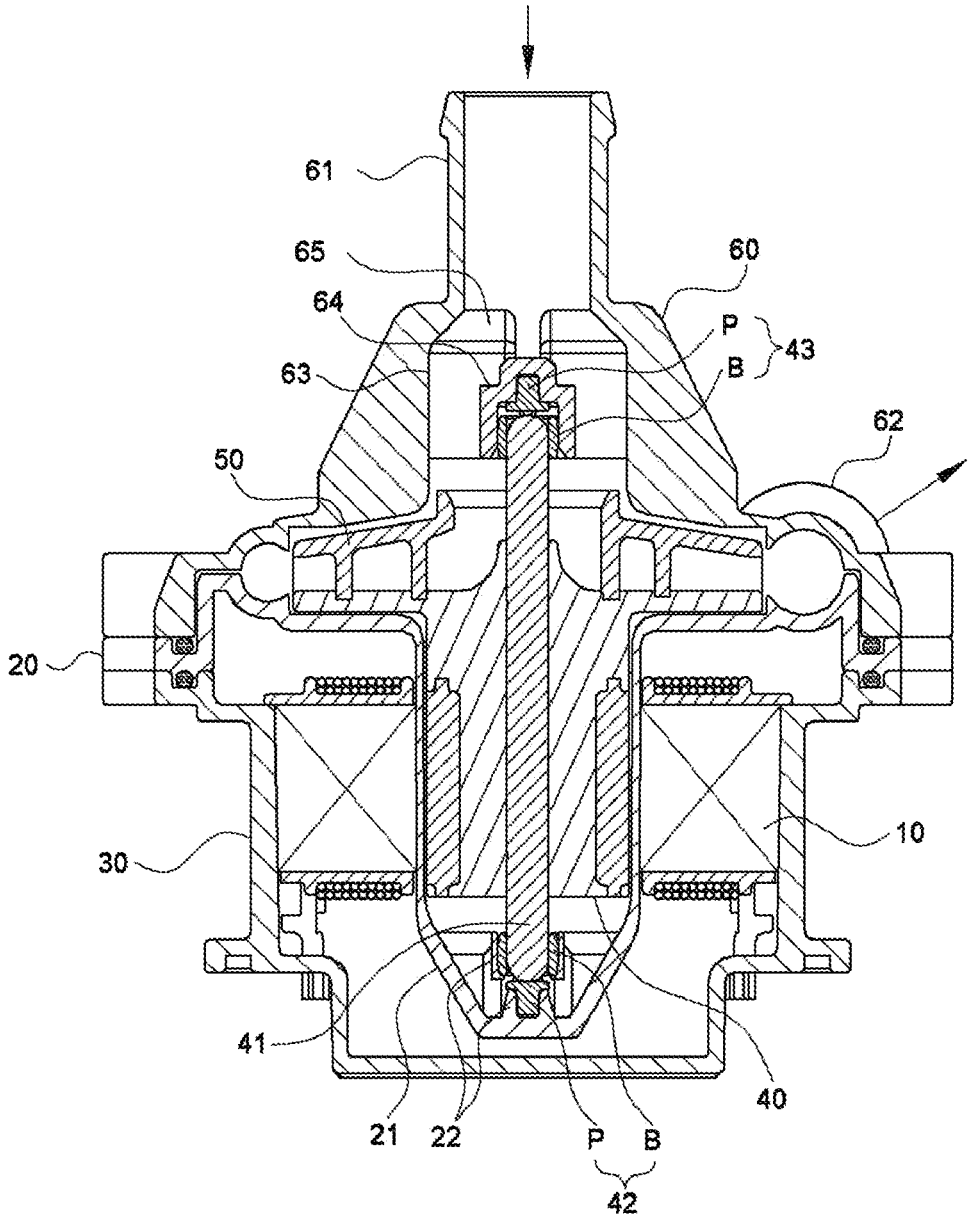
FIG. 1 is a front cross-sectional view illustrating an example of the conventional electric water pump.
Figure 2:
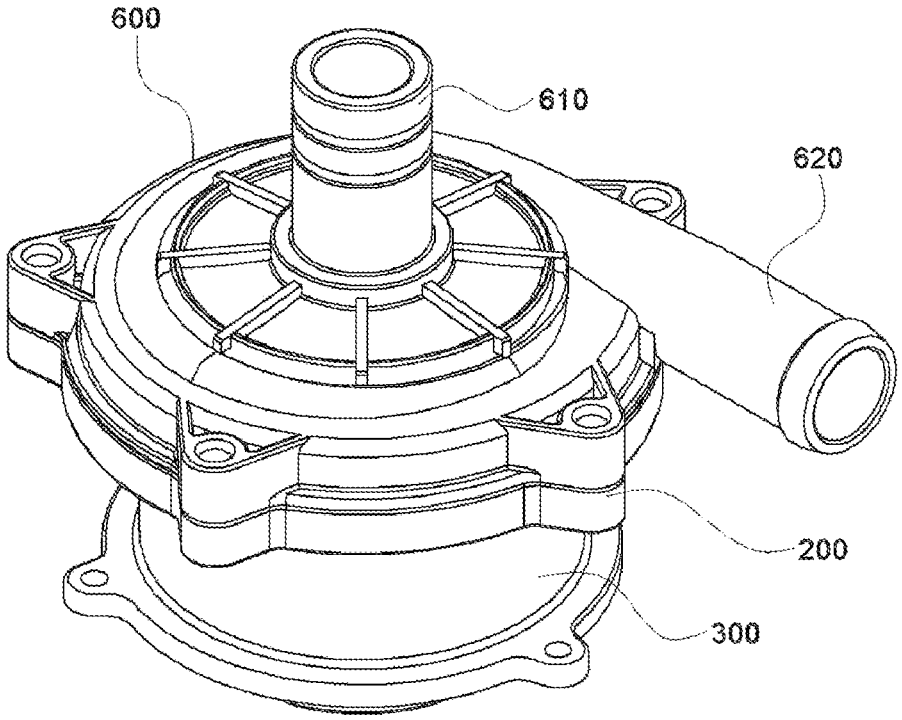
FIGS. 2 and 3 are an assembled perspective view and an exploded perspective view illustrating a water pump according to an embodiment of the present disclosure.
Figure 3:
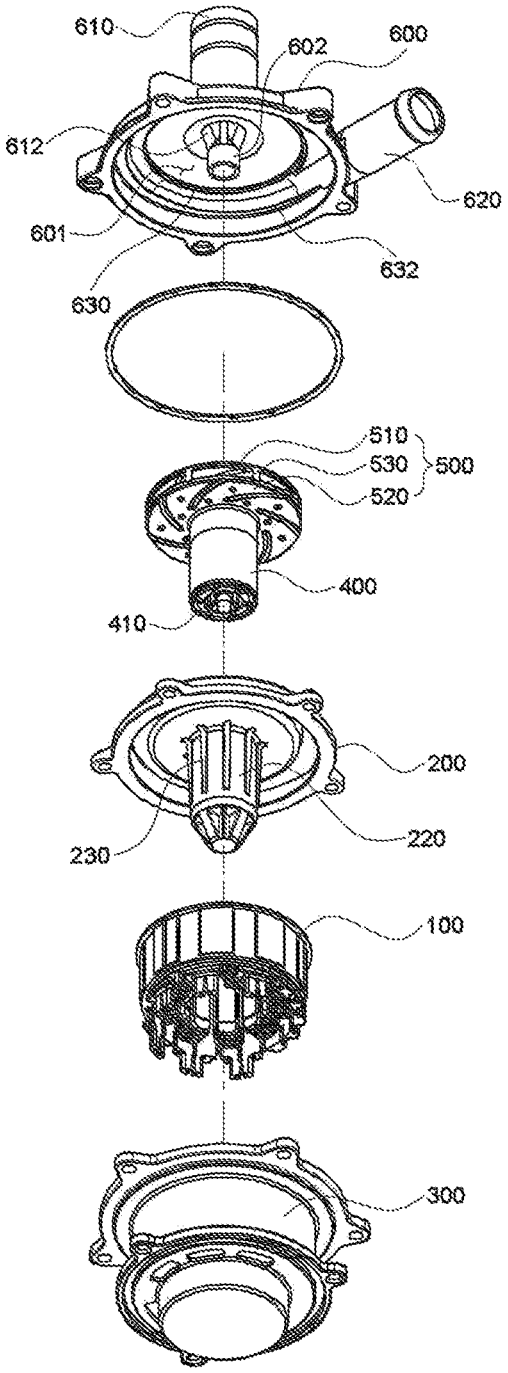
Figure 4:
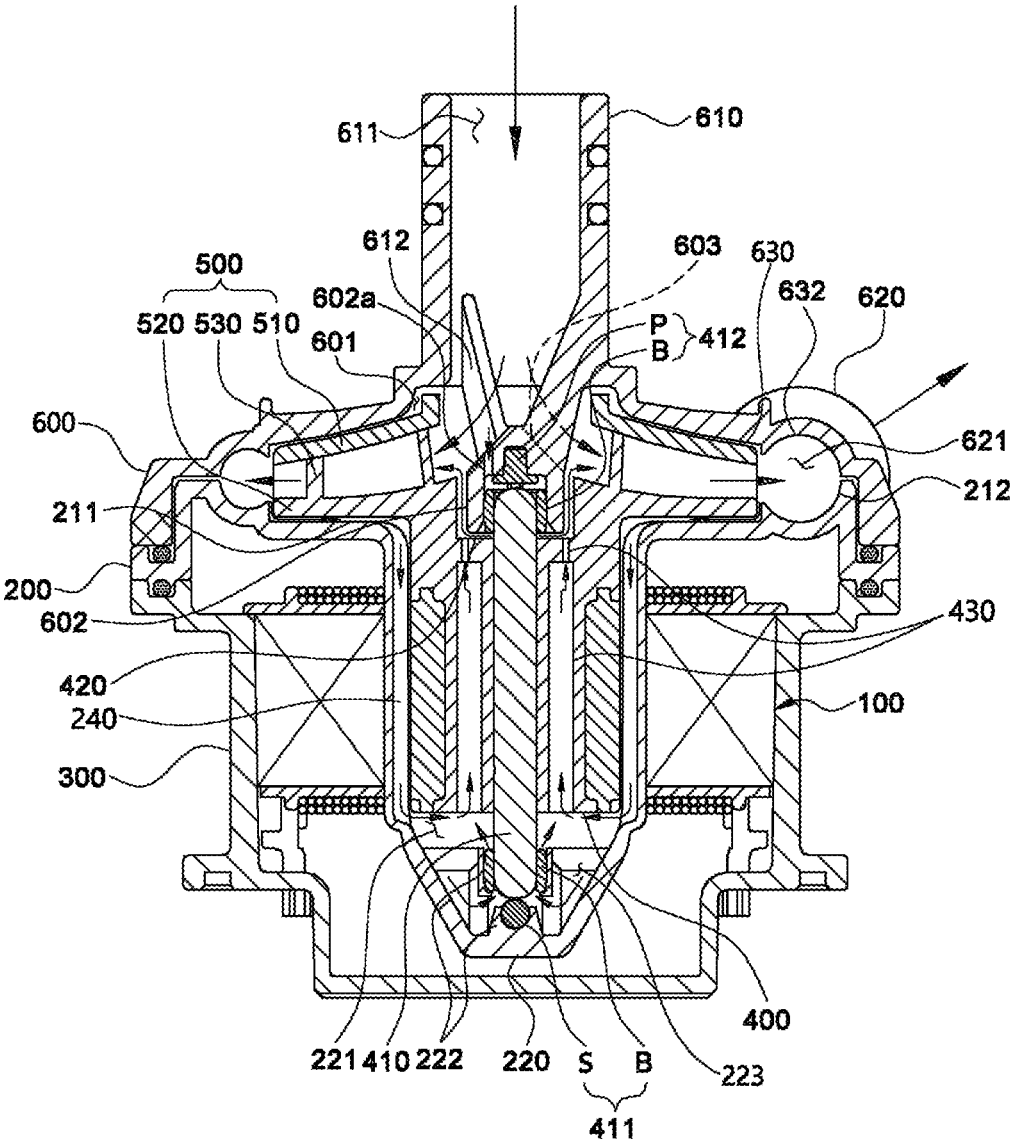
FIG. 4 is a front cross-sectional view illustrating the water pump according to the embodiment of the present disclosure.

FIGS. 2 and 3 are an assembled perspective view and an exploded perspective view illustrating a water pump according to an embodiment of the present disclosure, and FIG. 4 is a front cross-sectional view illustrating the water pump according to the embodiment of the present disclosure.

As illustrated, the water pump according to the embodiment of the present disclosure may be configured to include a lower casing 200, an upper casing 600, an impeller 500, and a rotor 400, and may be configured to further include a motor housing 300 and a stator 100.

The lower casing 200 may include a lower seating groove 211 which is formed to be recessed downward from an upper surface to accommodate a portion of the impeller 500, and a lower channel groove 212 which is formed to be recessed radially outside the lower seating groove 211 so that a fluid discharged from the impeller 500 may flow. In the lower casing 200, a rotor accommodation part 220 may be formed in the form of protruding downward from a center of the lower seating groove 211, and the rotor accommodation part 220 may be formed in the form of a container recessed downward on an upper side. In addition, a lower bearing mounting part 222 may be formed at a lower end of a rotor accommodation space 221 which is a recessed inside of the rotor accommodation part 220, so a lower bearing 411 may be coupled to the lower bearing mounting part 222. Here, the lower bearing 411 may include a bushing B capable of radially supporting a lower end of a rotary shaft 410 of the rotor 400 and a spherical ball S capable of axially supporting the lower end of the rotary shaft 410. Thus, the rotor 400 may be inserted into the rotor accommodation space 221, which is the inside of the rotor accommodation part 220, and an outer circumferential surface of the rotor 400 may be spaced apart from an inner circumferential surface of the rotor accommodation part 220. In addition, the rotor accommodation part 220 may be integrally formed with the lower casing 200 by injection molding. In addition, the rotor accommodation part 220 of the lower casing 200 is inserted into a hollow inside of the stator 100 and penetrates through the stator 100 so that a lower end of the rotor accommodation part 220 may protrude downward from a lower end of the stator 100 and the lower end of the rotor accommodation part 220 may be spaced apart from a bottom surface of the motor housing 300. In addition, an outer circumferential surface of the rotor accommodation part 220 may be coupled to an inner circumferential surface of the stator 100 in close contact.

The upper casing 600 is coupled to an upper side of the lower casing 200, the upper casing 600 and the lower casing 200 are coupled to each other, so an impeller accommodation space 601 in which the impeller 500 may be accommodated is formed inside between the upper casing 600 and the lower casing 200. Moreover, an upper seating groove 630 formed to be recessed upward to accommodate a portion of the impeller 500 is formed on a lower surface of the upper casing 600, and thus, the impeller accommodation space 601 is formed by the lower seating groove 211 and the upper seating groove 630. In addition, an upper channel groove 632 into which the fluid discharged from the impeller 500 flows is concavely formed at a position corresponding to the lower channel groove 212 of the lower casing 200 on the lower surface of the upper casing 600. In addition, the upper casing 600 has an inlet part 610 into which the fluid flows and an outlet part 620 through which the fluid is discharged, and an inlet channel 611 may be formed inside the inlet part 610 and an outlet channel 621 may be formed inside the outlet part 620. In addition, the upper casing 600 has a central portion vertically penetrating therethrough to make the upper seating groove 630 and the inlet channel 611 of the inlet part 610 communicate with each other, and the upper channel groove 632 and the lower channel groove 212 may communicate with the outlet channel 621 of the outlet 620. Here, the upper casing 600 has an upper bearing mounting part 602 extending from a lower end of the inlet part 610 toward the impeller accommodating space 601, so that the upper bearing mounting part 602 may be disposed under the lower end of the inlet part 610. That is, the upper bearing mounting part 602 may be disposed in the impeller accommodation space 601 under the inlet channel 611. In addition, the upper casing 600 may further include a plurality of supporting stands 612, and the supporting stands 612 may be spaced apart from each other along a circumferential direction. Each of the plurality of supporting stands 612 may have upper ends connected to a lower inner wall of the inlet part 610 and lower ends connected to the upper bearing mounting part 602, and the plurality of supporting stands 612 may extend from the top to the bottom in an inclined shape toward the inside in the radial direction. In addition, the upper bearing mounting part 602 has an inclined surface 603 inclined radially inward while an upper side goes upward, and the plurality of supporting stands 612 have the lower ends connected to the inclined surface 603 of the upper bearing mounting part 602. That is, the upper bearing mounting part 602 may be formed in the form in which an outer diameter gradually decreases from an approximately middle point upward in the vertical direction. In addition, an upper bearing 412 may be coupled to the upper bearing mounting part 602, and the upper bearing 412 may include the bushing B capable of radially supporting an upper end of the rotary shaft 410 of the rotor 400 and a support pin P capable of axially supporting the upper end of the rotary shaft 410. In addition, the upper bearing mounting part 602 and the supporting stand 612 may be integrally formed with the upper casing 600 by injection molding.

The impeller 500 serves to pump the fluid introduced through the inlet part 610 of the upper casing 600 toward the outlet part 620 by rotation. The impeller 500 may include an upper plate 510, a lower plate 520, and a blade 530, and a plurality of the blades 530 may be formed to be spaced from each other in a circumferential direction between the upper plate 510 and the lower plate 520 spaced apart from each other in a vertical direction. In addition, a through hole penetrating through both surfaces of the upper plate 510 vertically is formed in the central portion of the upper plate 510, and the inside of the impeller 500 communicates with the inlet channel 611, which is the inside of the inlet part 610, through the through hole. In addition, an outer peripheral edge of the impeller 500 is disposed close to the lower channel groove 212 and the upper channel groove 632, so the fluid discharged from the impeller 500 may flow along the outlet channel 621 formed by the channel grooves and then may be discharged through the outlet part 620 of the upper casing 600. In addition, for example, in the impeller 500, the blades 530 and the lower plate 520 may be integrally formed with a core part of the rotor 400, and the upper plate 510 may be formed in the form in which it is coupled to an upper side of the blade 530. In addition, the impeller may be formed in various forms. Thus, the fluid introduced into the inlet part 610 of the upper casing 600 may be introduced into the impeller 500 through the inlet channel 611 and the through hole of the upper plate 510 of the impeller 500, boosted by a centrifugal force according to the rotation of the impeller 500, flow into the outlet channel 621, and then flows along the outlet channel 621 to be discharged to the outside through the outlet part 620.

The rotor 400 is provided in the rotor accommodation space 221 of the lower casing 200, and the outer circumferential surface of the rotor 400 may be spaced apart from the inner circumferential surface of the rotor accommodation part 220 so as to be rotatably provided. In addition, in the rotor 400, a permanent magnet is coupled to a radially outer portion of the core part, and the rotary shaft 410 is coupled to a central axis of the core. In addition, the rotor 400 may have a lower end of the rotary shaft 410 rotatably coupled to the lower bearing 411 and the upper end rotatably coupled to the upper bearing 412.

Figure 5:
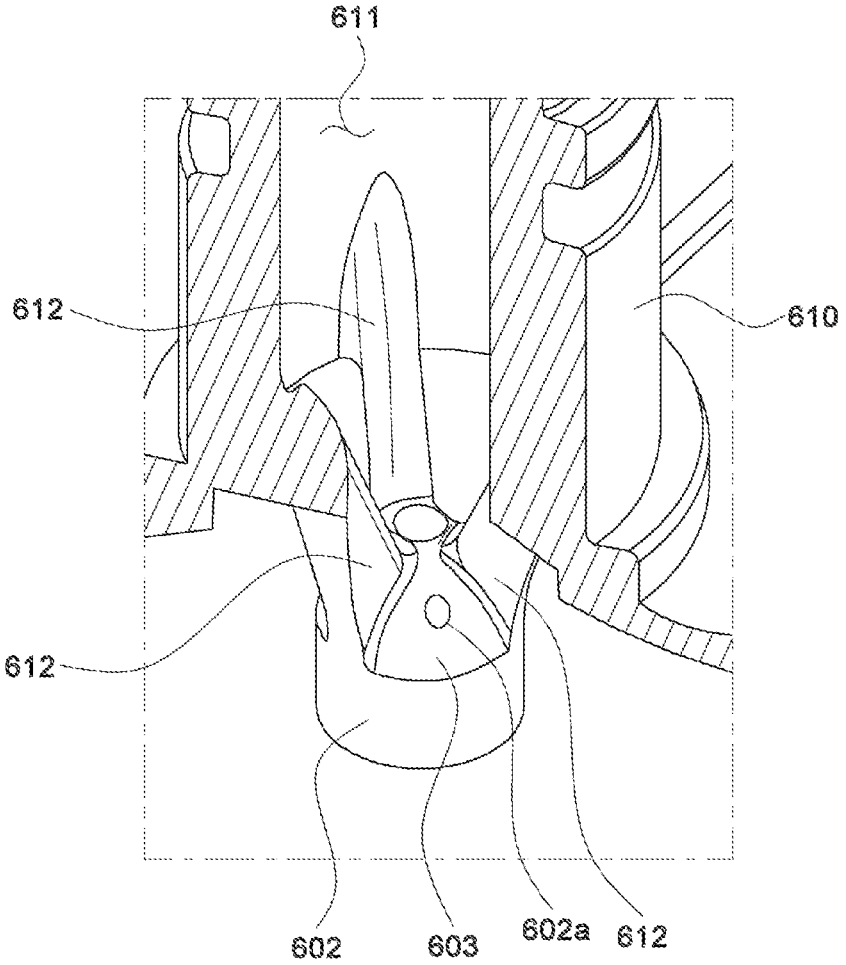
FIG. 5 is a partial cross-sectional perspective view illustrating a lower end of an inlet part and an upper bearing mounting part in an upper casing of the water pump according to the embodiment of the present disclosure.

FIG. 5 is a partial cross-sectional perspective view illustrating a lower end of the inlet part and the upper bearing mounting part in the upper casing of the water pump according to the embodiment of the present disclosure.

Here, referring to FIG. 5, cooling holes 602*a* penetrating through the inside and outside of the upper bearing mounting part 602 may be formed on the upper side of the upper bearing mounting part 602 in the vertical direction. Thus, a part of the fluid flowing toward the impeller 500 through the inlet channel 611 of the inlet part 610 may flow into the upper bearing mounting part 602 through the cooling hole 602*a*. The fluid introduced into the upper bearing mounting part 602 may lubricate and cool a surface where the bushing B and the support pin P of the upper bearing 412 come into contact with the rotary shaft 410. In addition, a fluid pressure difference between upper and lower regions of the upper bearing mounting part 602 may be reduced through the cooling hole 602*a*. Therefore, it is possible to reduce the occurrence of abnormal noise and vibration in the upper bearing mounting part during the rotation of the impeller and the rotor.

Figure 6:
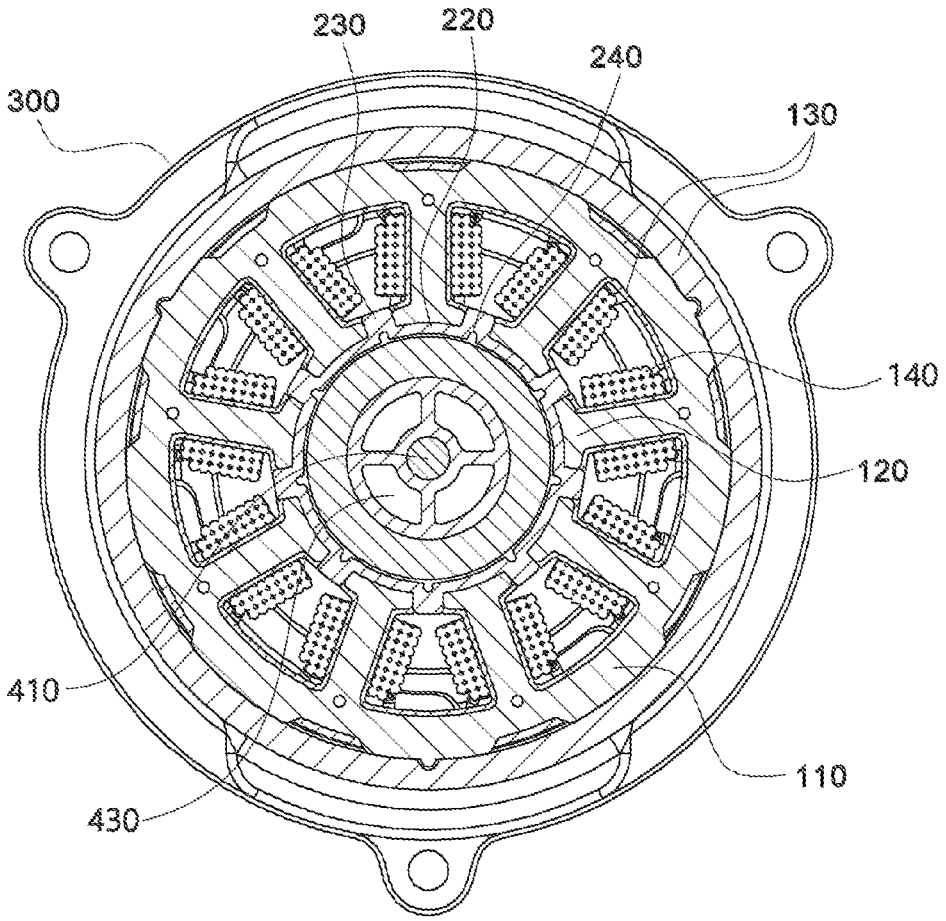
FIG. 6 is a plan cross-sectional view of the water pump according to the embodiment of the present disclosure.

FIG. 6 is a plan cross-sectional view of the water pump according to the embodiment of the present disclosure.

As illustrated, a communication channel 430 penetrating vertically may be formed in the rotor 400. The communication channel 430 may be formed by penetrating the upper and lower portions at a position spaced outward from the rotary shaft 410 in the radial direction. Also, an upper end of the communication channel 430 may be connected to an insertion groove 420 and a lower end of the communication channel 430 may be connected to a lower space of the rotor 400. Thus, an inlet side of the impeller 500 coupled to the upper end of the rotor 400 and the lower end side of the rotor 400 may communicate with each other by the communication channel 430 to reduce the pressure difference between the upper and lower regions of the rotor 400, so the rotor 400 may be cooled as the fluid circulates.

In addition, a communication groove 240 may be formed to be recessed on the inner circumferential surface of the rotor accommodation part 220 of the lower casing 200 along the vertical direction. That is, since the gap between the rotor accommodation part 220 and the rotor 400 is very small, the communication groove 240 may be formed on the inner circumferential surface of the rotor accommodation part 220 so that the fluid flows more smoothly. In addition, protruding ribs 230 may protrude outward in the radial direction from the outer circumferential surface of the rotor accommodation part 220, and each of the protruding ribs 230 may extend in the vertical direction. In addition, the protruding ribs 230 may be inserted between adjacent teeth 120 of the stator 100, respectively, and the communication groove 240 may be formed on the inner circumferential surface of the rotor accommodation part 220 at a position corresponding to the protruding rib 230.

In addition, a lower cooling channel 223 communicating with the inside of the lower bearing mounting part 222 may be formed in the rotor accommodation part 220 at an outer lower end of the lower bearing mounting part 222. That is, the lower cooling channel 223 through which the fluid may flow into the lower bearing mounting part 222 may be formed at the outer lower end of the lower bearing mounting part 222. In this case, the form of the lower cooling channel 223 may be formed in various ways, and the fluid may flow into a portion where the bushing B and the ball S of the lower bearing 411 come into contact with the rotary shaft 410 by the lower cooling channel 223, so that the lubrication and cooling action may be performed.

In addition, a portion or all of the upper bearing mounting part 602 may be disposed inside the inlet side of the impeller 500. That is, it may be disposed inside the inlet side of the impeller 500 as illustrated. For example, the insertion groove 420 may be formed to be recessed downward at the central portion of the lower plate 520, which is the lower end of the inlet side of the impeller 500, the upper bearing mounting part 602 may be inserted into the insertion groove 420, and the insertion groove 420 and the upper bearing mounting part 602 may be spaced apart from each other.

Thus, when the rotor 400 and the impeller 500 rotate, a portion of the fluid discharged from the impeller 500 flows between the lower plate 520 and the lower seating groove 211 of the impeller 500, passes between the rotor accommodation part 220 and the rotor 400, flows into the lower end of the rotor 400, and then flows into the insertion groove 420 through the communication channel 430 of the rotor 400. Then, the fluid may be circulated while repeating the process of being discharged by being joined with the fluid flowing into the inlet side of the impeller 500 again. Here, some of the fluid may lubricate and cool the upper bearing 412 through the cooling hole 602*a* on the upper side of the upper bearing mounting part 602, flow into the insertion groove 420 and rise, and be discharged through the impeller 500. In addition, some of the fluid at the lower end of the rotor 400 may flow along the lower cooling channel 223 to lubricate and cool the lower bearing 411, flow upward, and then flow into the insertion groove 420 through the communication channel 430 of the rotor 400.

The motor housing 300 may be formed in a recessed container made of a metal material, and may be formed to have an empty inside and have an upper side open. In addition, the motor housing 300 has a lower end closed, a side surface formed in a cylindrical shape, and an upper end of the motor housing may be provided with a flange protruding outward in the radial direction from an outer circumferential surface.

In the stator 100, for example, a plurality of teeth 120 may protrude radially inward from the inner circumferential surface of a cylindrical core 110, the teeth 120 may be disposed spaced apart from each other in the circumferential direction, an insulator 130 made of an electrical insulating material surrounds the core 110 and the teeth 120, and coils 140 may be wound on the outside of the teeth 120 surrounded by the insulator 130. In addition, the central part may be in the form of opening up and down. In addition, the stator 100 may be formed in various shapes and configurations. In addition, the stator 100 may be provided inside the motor housing 300, and the outer circumferential surface of the stator 100 may be coupled and fixed to an inner circumferential surface of the motor housing 300 in close contact.

According to an embodiment of the present disclosure, it is possible to reduce the occurrence of abnormal noise and vibration in a bearing part by smoothing a lubrication action of a bearing and reducing a pressure difference between upper and lower sides of an assembly of a rotor and an impeller.

The present disclosure is not limited to the abovementioned exemplary embodiments, but may be variously applied. In addition, the present disclosure may be variously modified by those skilled in the art to which the present disclosure pertains without departing from the gist of the present disclosure claimed in the claims.

What is claimed is:

1. A water pump, comprising:

a lower casing in which a rotor accommodation part having a rotor accommodation space formed to be recessed from an upper surface to a lower side protrudes downward, a lower bearing mounting part is formed at an inner lower end of the rotor accommodation part, and a lower bearing is coupled to an inside of the lower bearing mounting part;

an upper casing coupled to an upper side of the lower casing, having an impeller accommodation space therein by coupling with the lower casing, having an inlet part communicating with the impeller accommodation space to have a fluid be introduced thereinto and an outlet part through which the fluid is discharged, having an upper bearing mounting part extending from the inlet part, and having an upper bearing coupled to an inside of the upper bearing mounting part;

an impeller provided to be rotatable in the impeller accommodation space; and a rotor provided in the rotor accommodation space of the lower casing, coupled to the impeller, and having both ends of a rotary shaft rotatably coupled to the lower bearing and the upper bearing, wherein the upper bearing mounting part is provided with a cooling hole vertically penetrating through the inside and outside of the upper bearing mounting part, wherein the rotor is provided with a communication channel penetrating up and down, and an inlet side of the impeller coupled to an upper end of the rotor and a lower end side of the rotor communicate with each other by the communication channel.

2. The water pump of claim 1, wherein the rotor accommodation part of the lower casing is provided with a communication groove formed to be recessed on an inner circumferential surface along a vertical direction.

3. The water pump of claim 1, wherein the rotor accommodation part is provided with a lower cooling channel communicating with the inside of the lower bearing mounting part at an outer lower end of the lower bearing mounting part.

4. The water pump of claim 1, wherein the upper casing further includes a plurality of supporting stands having an upper end connected to a lower inner wall of the inlet part and a lower end connected to the upper bearing mounting part, and the upper bearing mounting part extends from a lower end of the inlet part toward the impeller accommodation space.

5. The water pump of claim 4, wherein a portion or all of the upper bearing mounting part is disposed inside an inlet side of the impeller.

6. The water pump of claim 5, wherein the lower end of the inlet side of the impeller and an upper end of the rotor are provided with an insertion groove formed to be recessed downward, and the upper bearing mounting part is inserted into the insertion groove and spaced apart therefrom.

7. The water pump of claim 6, wherein the rotor is provided with a communication channel connecting a lower end side of the rotor and the insertion groove through the top and bottom thereof.

8. The water pump of claim 1, further comprising:

a motor housing formed in a shape of a concave container with an upper side open; and a stator provided inside the motor housing.

9. The water pump of claim 8, wherein a protruding rib is formed on an outer circumferential surface of the rotor accommodation part of the lower casing along a vertical direction, and the protruding rib is inserted between adjacent teeth of the stator, and a communication groove is formed to be recessed on an inner circumferential surface along the vertical direction at a position corresponding to the protruding rib.

* * * * *